US012680444B2

(12) United States Patent
Taylor, Jr. et al.

(10) Patent No.: US 12,680,444 B2
(45) Date of Patent: Jul. 14, 2026

(54) APPARATUS AND METHODS FOR DEPLOYING SENSOR IN DOWNHOLE TOOL

(71) Applicant: Weatherford Technology Holdings, LLC, Houston, TX (US)

(72) Inventors: James H. Taylor, Jr., Houston, TX (US); William Allen Schultz, Jr., Cypress, TX (US); Albert C. Odell, II, Kingwood, TX (US); Glenn Iversen, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 19/064,686

(22) Filed: Feb. 26, 2025

(65) Prior Publication Data

US 2025/0198278 A1 Jun. 19, 2025

Related U.S. Application Data

(60) Division of application No. 18/761,295, filed on Jul. 1, 2024, now Pat. No. 12,264,575, which is a division of application No. 18/370,687, filed on Sep. 20, 2023, now Pat. No. 12,140,015, which is a continuation of application No. PCT/US2022/035143, filed on Jun. 27, 2022.

(60) Provisional application No. 63/215,008, filed on Jun. 25, 2021.

(51) Int. Cl.
*E21B 47/01* (2012.01)
*E21B 23/03* (2006.01)

(52) U.S. Cl.
CPC ..... *E21B 47/01* (2013.01); *E21B 23/03* (2013.01)

(58) Field of Classification Search
CPC ..... E21B 47/01; E21B 23/03
See application file for complete search history.

(56) References Cited

U.S. PATENT DOCUMENTS

| | | | | |
|---|---|---|---|---|
| 3,466,597 | A | 9/1969 | Richter, Jr. et al. | |
| 2003/0062156 | A1* | 4/2003 | Zillinger | E21B 47/06 166/113 |
| 2004/0089446 | A1* | 5/2004 | Sugden | E21B 37/10 166/227 |
| 2011/0120701 | A1* | 5/2011 | Hall | E21B 17/00 166/242.1 |
| 2014/0150544 | A1 | 6/2014 | Logan et al. | |

(Continued)

FOREIGN PATENT DOCUMENTS

| | | | |
|---|---|---|---|
| CA | 3162968 | A1 | 7/2021 |
| WO | 2018167462 | A1 | 9/2018 |

OTHER PUBLICATIONS

Int'l Search Report and Written Opinion in PCT/US2022/035143 dated Mar. 11, 2022, 14-pgs.

*Primary Examiner* — Caroline N Butcher
(74) *Attorney, Agent, or Firm* — Cabello Hall Zinda, PLLC

(57) ABSTRACT

A downhole assembly includes a tubular body having a bore and a downhole tool connected to the tubular body. The downhole assembly also includes a sensor assembly having a carrier and a sensor. A sensor adapter is used to couple the sensor assembly to the tubular body. The sensor adapter includes an adapter body disposed in the bore of the tubular body; an adapter shaft for connection with the carrier; and a plurality of channels formed between the adapter shaft and the adapter body.

20 Claims, 11 Drawing Sheets

(56) References Cited

U.S. PATENT DOCUMENTS

| | | | | |
|---|---|---|---|---|
| 2019/0010765 | A1 | 1/2019 | Stack et al. | |
| 2021/0017856 | A1* | 1/2021 | Feddema | E21B 10/602 |
| 2021/0040844 | A1* | 2/2021 | Wisinger, Jr. | E21B 45/00 |

* cited by examiner

APPARATUS AND METHODS FOR DEPLOYING SENSOR IN DOWNHOLE TOOL

CROSS-REFERENCE TO RELATED APPLICATION

This is a divisional of U.S. application Ser. No. 18/761,295 filed Jul. 1, 2024, which is a divisional of U.S. application Ser. No. 18/370,687 filed Sep. 20, 2023-now U.S. Pat. No. 12,140,015, which is a continuation of International Application No. PCT/US2022/035143 filed Jun. 27, 2022, which claims priority to U.S. Provisional Patent Application No. 63/215,008, filed Jun. 25, 2021, each of which is incorporated herein by reference in its entirety.

BACKGROUND

Field

Embodiments of the present disclosure relate apparatus and methods of deploying a sensor in a downhole tool. In particular, this disclosure relates to deploying a sensor in a bottom hole assembly having a milling tool.

Description of the Related Art

In recent years, technology has been developed which allows an operator to drill a primary well, and then continue drilling an angled lateral borehole off of the primary well at a chosen depth. Generally, the primary, or "parent" wellbore, is first drilled and then supported with strings of casing. The strings of casing are cemented into the formation by the extrusion of cement into the annular regions between the strings of casing and the surrounding formation. The combination of cement and casing strengthens the wellbore and facilitates the isolation of certain areas of the formation behind the casing for the production of hydrocarbons.

A lateral wellbore can also be formed off of a parent wellbore. The parent wellbore can be cased or open hole. To form a lateral or "sidetrack" wellbore, a tool known as a whipstock is positioned in the parent wellbore at the depth where deflection is desired, typically at or above one or more producing zones. The whipstock is used to divert milling bits into a side of the parent wellbore to create a pilot borehole in the parent wellbore. Thereafter, a drill bit is run into the parent wellbore. The drill bit is deflected against the whipstock and is urged through the pilot borehole. From there, the drill bit contacts the rock formation in order to form the new lateral hole in a desired direction.

When forming the lateral wellbore through the parent wellbore, an anchor is first set in the parent wellbore at a desired depth. The anchor is typically a packer having slips and seals. The anchor tool acts as a fixed body against which tools above it may be urged to activate different tool functions. The anchor tool typically has a key or other orientation-indicating member.

A whipstock is next run into the wellbore. The whipstock has a body that lands into or onto the anchor. A stinger is located at the bottom of the whipstock which engages the anchor device. At a top end of the body, the whipstock includes a deflection portion having a concave face. The stinger at the bottom of the whipstock body allows the concave face of the whipstock to be properly oriented so as to direct the milling operation. The deflection portion receives the milling bits as they are urged downhole. In this way, the respective milling bits are directed against the surrounding wellbore for forming the pilot borehole.

In order to form the pilot borehole, a milling bit, or "mill," is placed at the end of a string of drill pipe or other working string. In some milling operations, a series of mills is run into the hole. First, a starting mill is run into the hole on a tubular string. Rotation of the string rotates the starting mill, causing a portion of the wellbore to be removed. This mill is followed by other mills, which complete the pilot borehole or extend the lateral wellbore.

In some instances, it is useful to obtain information regarding the milling operation. For example, a bottom hole assembly can include a measurement-while-drilling ("MWD") tool. The MWD tool typically includes a tubular body that is threadedly connected to the drilling string.

There is a need, therefore, for apparatus and methods of installing a sensor in a downhole tool.

BRIEF DESCRIPTION OF THE DRAWINGS

So that the manner in which the above recited features of the present disclosure are attained and can be understood in detail, a more particular description of the disclosure, briefly summarized above, may be had by reference to the drawings that follow. The drawings illustrate only selected embodiments of this disclosure and are not to be considered limiting of its scope.

DETAILED DESCRIPTION

Figure 1:
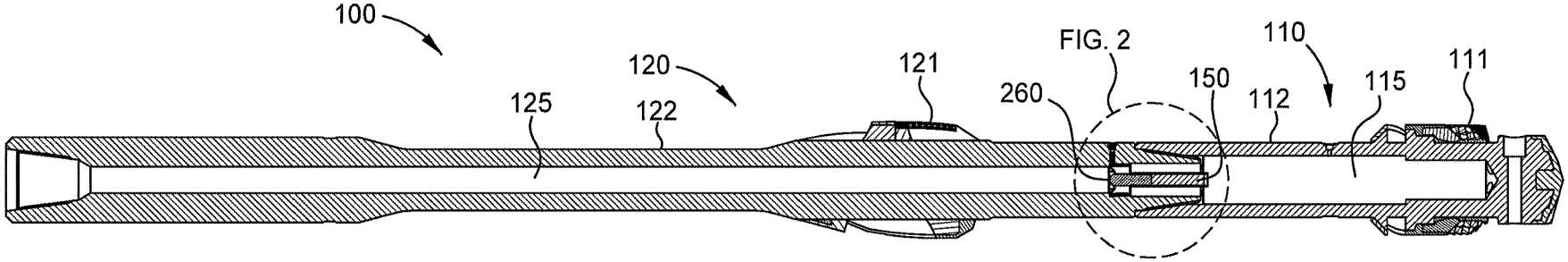
FIG. 1 is a cross-sectional view of a milling tool according to one embodiment.

The present disclosure provides apparatus and methods of installing a sensor in a downhole tool. An exemplary downhole tool is a milling tool. FIG. 1 is a cross-sectional view of a milling tool 100 according to one embodiment. The milling tool 100 may be used to form a lateral wellbore off of a parent wellbore. As shown, the milling tool 100 includes a first mill 110 and a second mill 120. The first mill 110 includes one or more milling blades 111 disposed at a lower portion of a tubular body 112. The second mill 120 includes one or more milling blades 121 disposed around an exterior of a tubular body 122. The tubular body 122 of the second mill 120 can be threadedly connected to the upstream end of the tubular body 112 of the first mill 110. It is contemplated that the tubular body 112, 122 of the first and second mills 110, 120 may form an integrated tubular body. In another embodiment, the first and second mills 110, 120 may be connected using one or more additional tubular bodies. Each of the tubular bodies 112, 122 include a bore 115, 125 in fluid communication with the bore of an adjacent tubular body.

Figure 2:
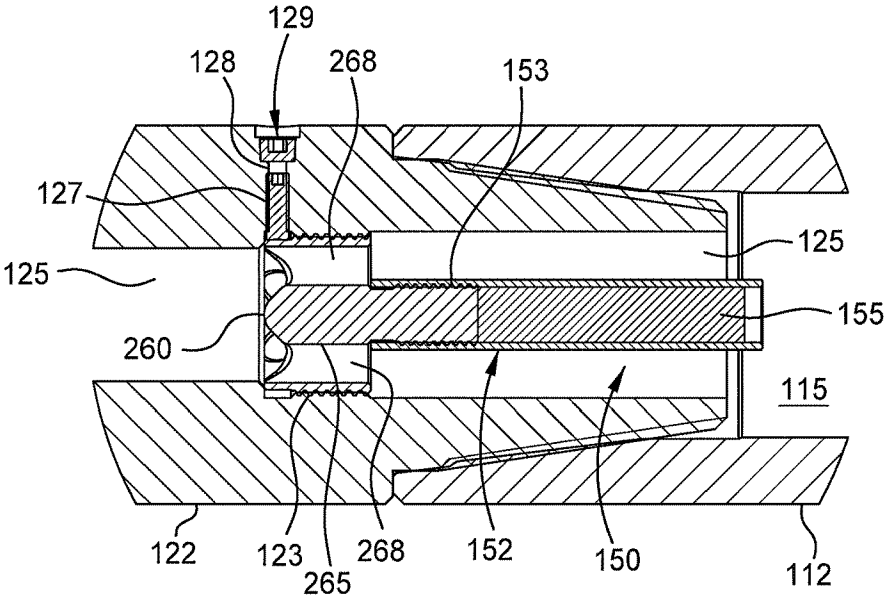
FIG. 2 is an enlarged partial view of the milling tool of FIG. 1.

FIG. 2 shows the milling tool 100 equipped with an exemplary embodiment of a sensor adapter 260 for retaining a sensor assembly 150 in the milling tool 100. FIG. 2 is an enlarged partial view of FIG. 1. The adapter 260 is disposed in the bore 125 of the tubular body 122 of the second mill 120. The second mill 120 is connected to the first mill 110.

Figure 3:
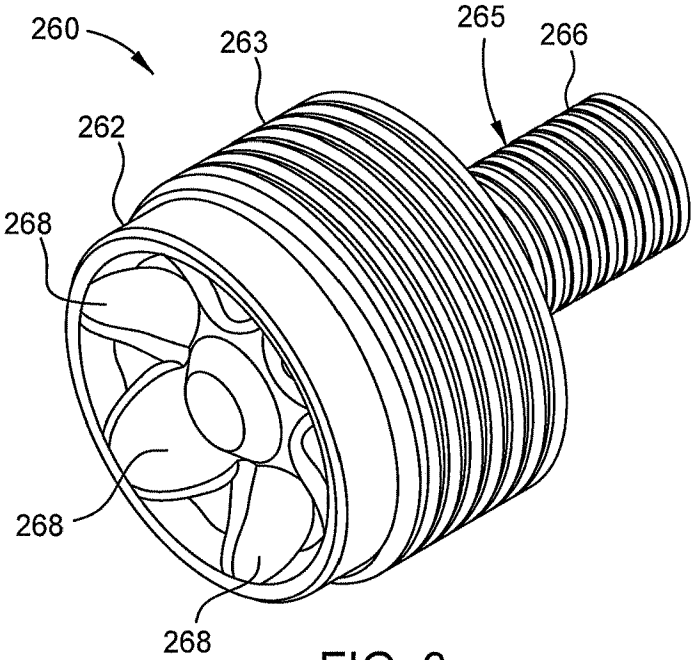
FIG. 3 is a perspective view of a sensor adapter according to one embodiment.

FIG. 3 is a perspective view of the sensor adapter 260. FIG. 2 shows a cross-sectional view of the sensor adapter 260. The sensor adapter 260 includes an adapter body 262 configured to attach to an inner surface of the tubular body 122. In this embodiment, threads 263 formed on the exterior surface of the adapter body 262 are mateable with threads 123 formed on the inner surface of the tubular body 122. It is contemplated that the adapter body 262 may be connected to the tubular body 122 of the second mill 120 using other suitable connection devices, such as a screw or a snap ring. The adapter 260 includes an adapter shaft 265 for connection to the sensor assembly 150. The adapter shaft 265 extends out of the downstream end of the adapter body 262 for connection with the sensor assembly 150. In this embodiment, the adapter shaft 265 includes threads 266 for connection with the sensor assembly 150. It is contemplated that the adapter shaft 265 may be connected to the sensor assembly 150 using other suitable connection devices, such as a screw or a snap ring. It is further contemplated the adapter shaft 265 may extend out of the upstream for connection with the sensor assembly 150.

In this embodiment, the adapter shaft 265 is positioned in co-axial alignment with the longitudinal axis of the adapter body 262, and the adapter body 262 is positioned in co-axial alignment with the longitudinal axis of the tubular body 122. This arrangement also positions the sensor assembly 150 in co-axial alignment with the tubular body 122. The adapter body 262 includes one or more channels 268 disposed around the adapter shaft 265 for fluid communication. FIG. 3 shows six channels 268 disposed circumferentially around the adapter shaft 265, although any suitable number of channels may be used, such as two, three, four, five, or eight channels. The channels 268 may be sized for maximum fluid flow through the adapter body 262. In one example, the channels 268 are bores formed through the adapter body 262. In one embodiment, the upstream end of the channels 268 is recessed, and the upstream end of the adapter shaft 262 has a bullet nose shape 269 to deflect flow into the channels 268. In another embodiment, the adapter shaft 265 may be eccentrically positioned relative to the longitudinal axis of the tubular body 122. For example, the longitudinal axis of the adapter shaft 265 is in parallel offset alignment with the longitudinal axis of the tubular body 122. The channels 268 are disposed in the space between the adapter shaft 265 and the adapter body 262. The channels 268 may have different diameter sizes.

Referring back to FIG. 2, the adapter 260 is disposed in the bore 125 of the tubular body 122, and the adapter body 262 is threadedly connected to the threads 123 on the inner surface of the tubular body 122. As shown, an optional secondary connection device 127, such as a screw or pin, is used to connect the adapter 260 to the tubular body 122. For example, one or more set screws may be circumferentially disposed around the tubular body 122 to connect the adapter 260 to the tubular body 122. The screws may be inserted through holes 128 formed in the wall of the tubular body 122. The holes 128 may be closed using a plug 129. In one example, the plug 129 is a national pipe thread ("NPT") plug. It must be noted that the connection device, such as the set screws, may be used instead of the threads on the adapter 260. Although the adapter 260 is shown attached to the second mill 120, it is contemplated that the adapter 260 can be attached to the first mill 110.

The sensor assembly 150 is attached to the adapter shaft 262. In one embodiment, the sensor assembly 150 includes a sensor carrier 152 for connection to the adapter shaft 262. In this embodiment, the inner surface of the sensor carrier 152 includes threads 153 for mating with threads 266 of the adapter shaft 262. One or more sensors 155 are disposed in the sensor carrier 152. In addition to retaining the sensors 155, the sensor carrier 152 may protect the sensors 155 from the wellbore pressure and the wellbore fluids.

Figure 2A:
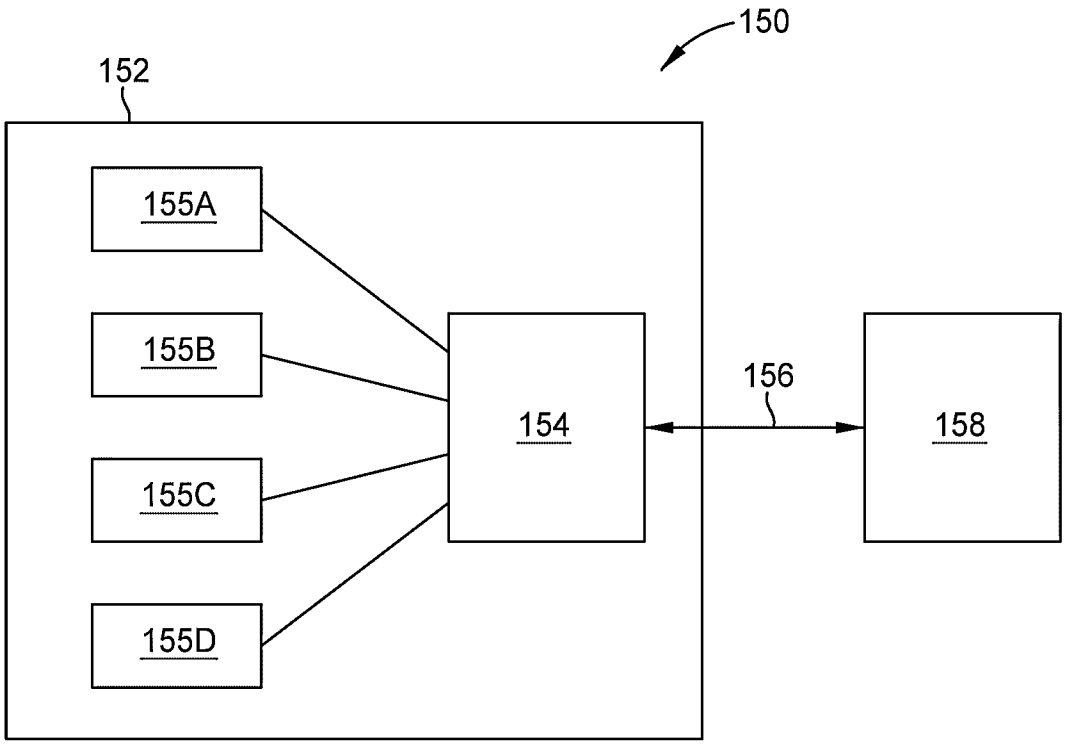
FIG. 2A is a schematic diagram of a sensor assembly according to one embodiment.

FIG. 2A is a schematic diagram of the sensor assembly 150 according to one embodiment of the present disclosure. The sensor assembly 150 may include one or more sensors 155 for measuring a geophysical parameter. Exemplary geophysical parameters include gravity, pressure, vibration, electromagnetic waves, Earth's magnetic field, velocity, orientation, deviation, acceleration, resistivity, porosity, and gamma ray.

In one example, the sensor assembly 150 may include a sensor 155A for measuring orientation of the milling tool 100. In one embodiment, the sensor 155A is a magnetometer which is useful to describe the orientation of the element it is attached to in the earth's magnetic field.

The sensor assembly 150 may include a sensor 155B for measuring a parameter such as gravity. The sensor 155B may be a micro-electromechanical system ("MEMS")-based sensor. In one example, MEMS-based sensor may include chips with microelectromechanical structures that move according to gravity. In another embodiment, the sensor may operate on an accelerometer principle that uses gravitational acceleration.

The sensor assembly 150 may include a sensor 155C for measuring velocity. In one embodiment, the sensor 155C may be a gyrometer. In one embodiment, the sensor 155C may be a 3-axis gyrometer. Alternatively, the sensor 155C may be any suitable sensor for measuring velocity.

The sensor assembly 150 may include a sensor 155D for measuring acceleration. In one embodiment, the sensor 155D may be an accelerometer. In one embodiment, the sensor 155D may be a 3-axis accelerometer. Alternatively, the sensor 155D may be any sensor suitable for measuring acceleration.

Even though four sensors 155A, 155B, 155C, 155D are shown in FIG. 2A, the sensor assembly 150 may include one or more of these sensors and/or other suitable sensors, such as a Geiger-Müller tube sensor.

The sensor assembly 150 may further include a control board 154 connected to the sensors 155A, 155B, 155C, 155D. The control board 154 may include input/output ports to connect with the sensors 155A, 155B, 155C, 155D. The control board 154 may establish a communication 156 with the controller 158. The communication 156 may be a wired communication.

In one embodiment, the carrier 152 may be a hermetic housing that encloses the sensors 155A, 155B, 155C, 155D and the control board 154 therein. The carrier 152 may further include structures, such as threads and screws, to permit secure attachment of the sensor assembly 150 to the tubular body 122 of the second mill 120. In one embodiment, the sensor assembly 150 may include a power source such as a battery.

In one example, the controller 158 may be a computer. The controller 158 may include a display screen. The controller 158 may include computer programs or an application for analyzing measurements from the sensor assembly 150. In one embodiment, the controller 158 may include a program for displaying a graphical representation of the movement of the milling tool 100 in the earth. In some embodiments, the graphical presentation can include time and depth-based plots of the data.

Figure 4:
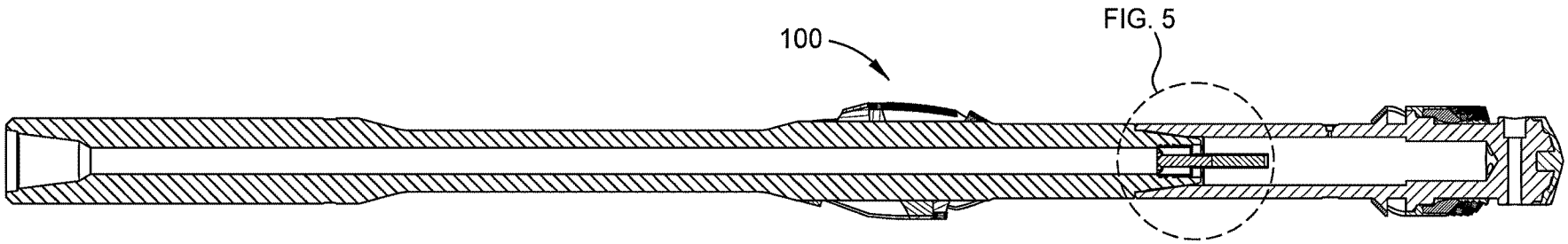
FIG. 4 shows a milling tool equipped with another embodiment of a sensor adapter.
Figure 5:
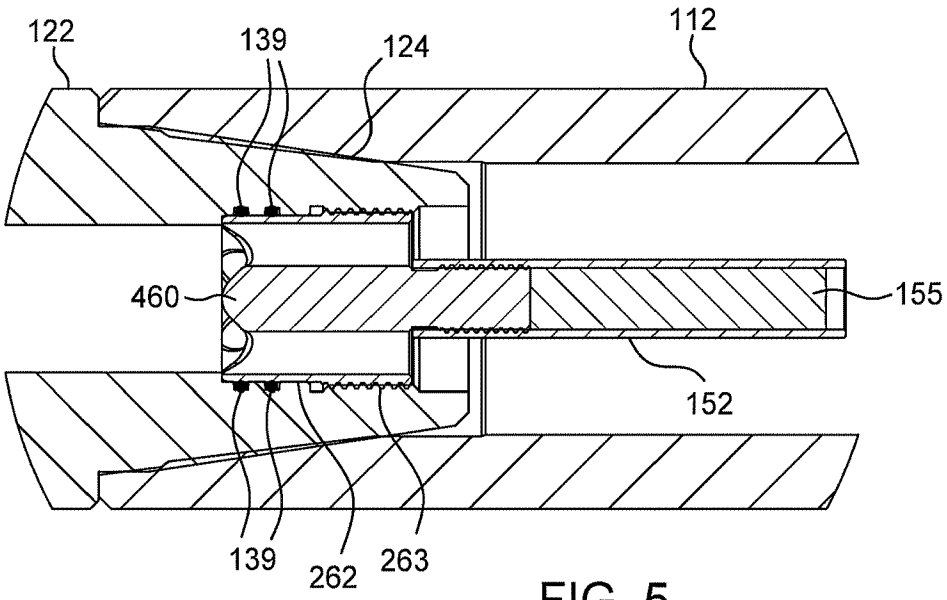
FIG. 5 is an enlarged partial view of the milling tool of FIG. 4.
Figure 6:
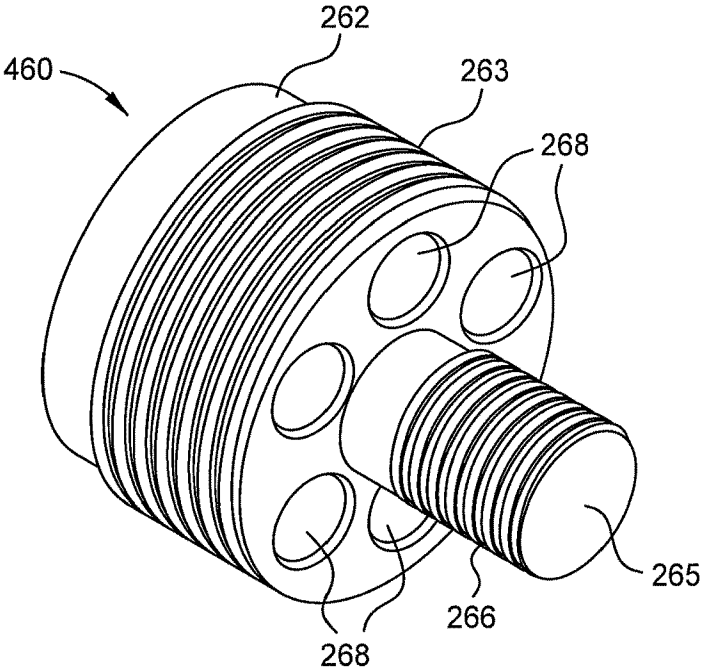
FIG. 6 is a perspective view of the sensor adapter of FIG. 4.

FIG. 4 shows the milling tool 100 equipped with another embodiment of a sensor adapter 460. FIG. 5 is an enlarged partial view of FIG. 4. FIG. 6 is a perspective view of the sensor adapter 460 from the downstream end. The milling tool 100 is similar to the milling tool 100 of FIG. 1. The sensor adapter 460 is substantially similar to the sensor adapter 260 of FIG. 2. For clarity's sake, similar features are designated with the same reference number and will not be described further in detail. In this embodiment, one or more O-rings 139 are used to hydrostatically hold the sensor adapter 460 in the tubular body 122 of the second mill 120. As shown, the one or more O-rings 139 are disposed between the tubular body 122 and the non-threaded portion of the adapter body 262. Although two O-rings 139 are shown, one, three or more O-rings may be used. Because the set screws 127 are not used, the adapter 460 may be moved downstream of the tubular body 122 to a position adjacent to the threads 124 that connect to the first mill 110. In this position, the sensor assembly 150 is moved closer to the head of the first mill 110, which, depending on the data measured, may provide a more accurate measurement.

Figure 7:
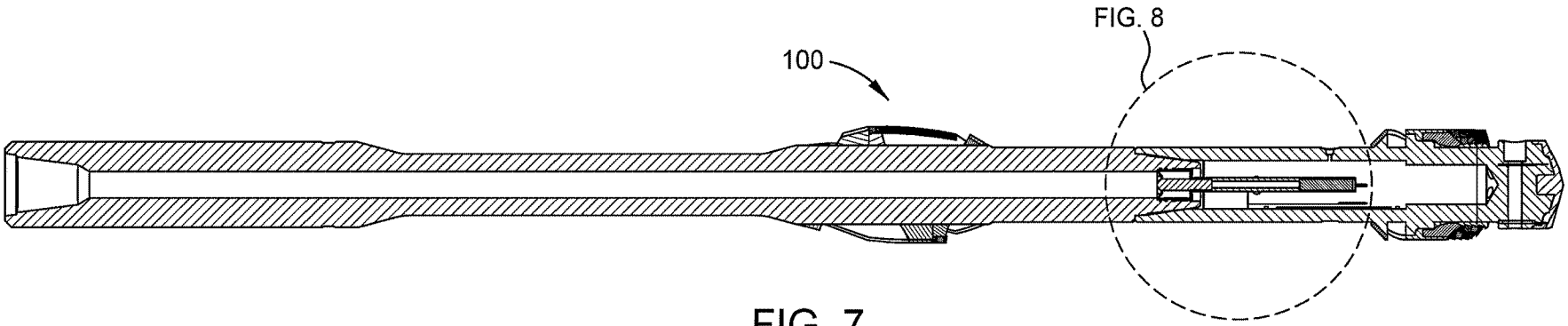
FIG. 7 shows a milling tool equipped with another embodiment of a sensor assembly.
Figure 8:
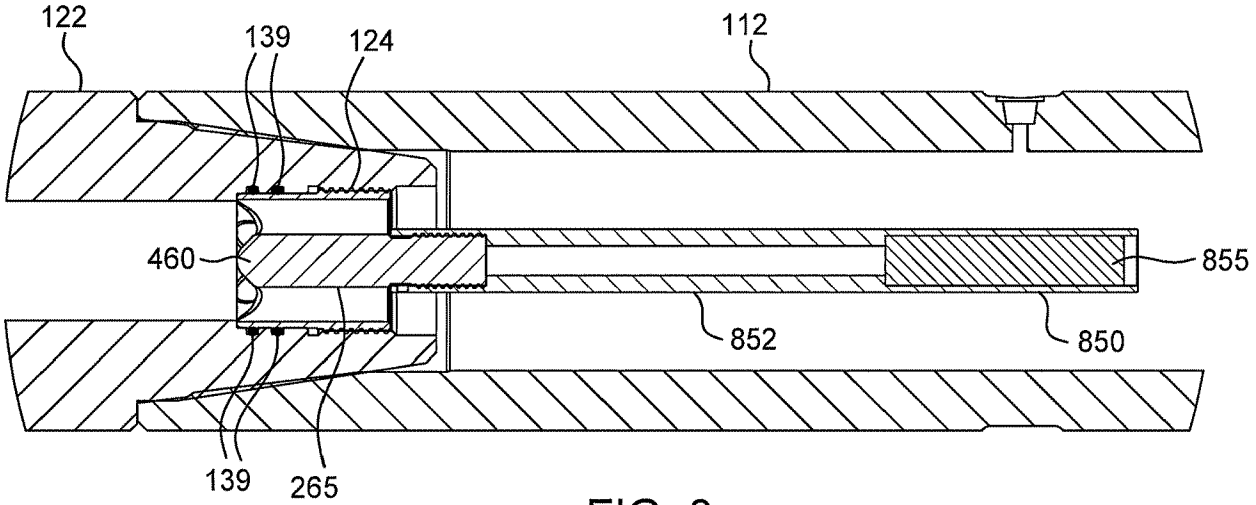
FIG. 8 is an enlarged partial view of the milling tool of FIG. 7.

FIG. 7 shows the milling tool 100 equipped with another embodiment of a sensor assembly 850. FIG. 8 is an enlarged partial view of FIG. 7. The milling tool 100 is similar to the milling tool 100 of FIG. 4. The milling tool 100 is equipped with the sensor adapter 460 of FIG. 4. For clarity's sake, similar features are designated with the same reference number and will not be described further in detail. The sensor adapter 460 is positioned adjacent to the threads 124 for connection to the tubular body 112 of the first mill 110. One or more O-rings 139 are used to hydrostatically hold the sensor adapter 460 in the tubular body 122 of the second mill 120. In this embodiment, the sensor assembly 850 includes a sensor carrier 852 connected to the adapter shaft 265 and houses the sensor 855. The sensor carrier 852 is elongated to position the sensors 855 closer to the head of the first mill 110. The elongated carrier 852 may be positioned the sensor 855 away from the sensor adapter 460 at a distance from 1 ft. to 15 ft. In one example, the elongated carrier 852 may position the sensor 855 away from the end of the adapter shaft 265 at a distance from 1 ft. to 15 ft. It is contemplated that the elongated carrier 852 can be used with the sensor adapter 260 of FIG. 1.

Figure 9:
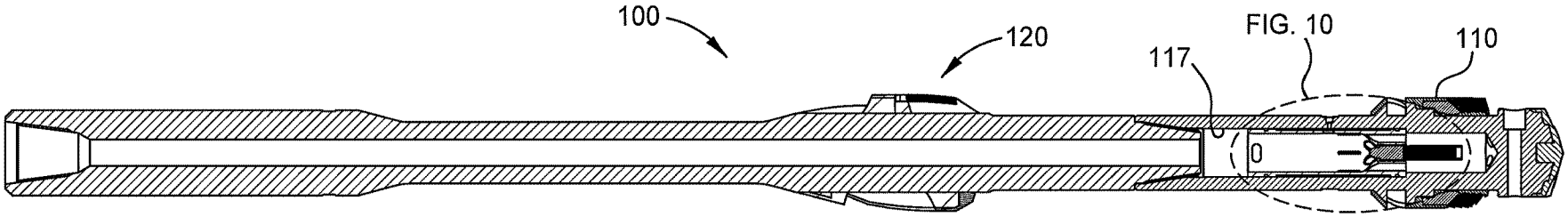
FIG. 9 shows a milling tool equipped with another embodiment of a sensor adapter.
Figure 10:
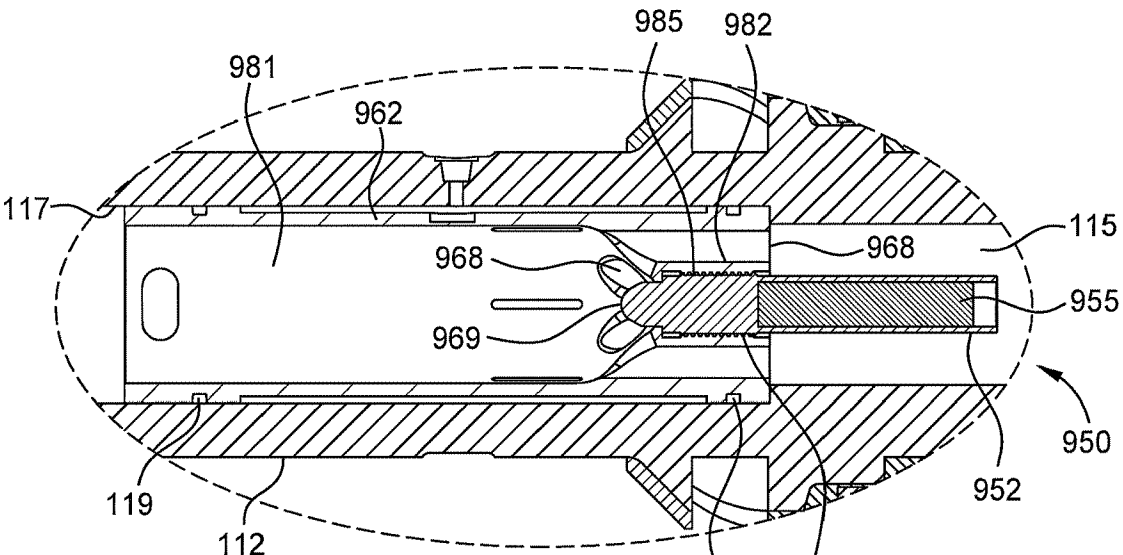
FIG. 10 is an enlarged partial view of the milling tool of FIG. 9.
Figure 11:
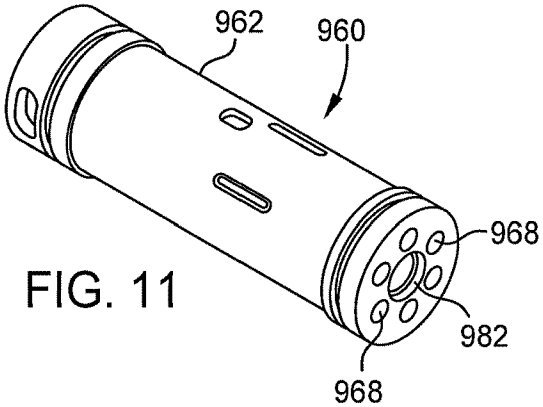
FIG. 11 is a perspective view of the sensor adapter of FIG. 9.
Figure 11A:
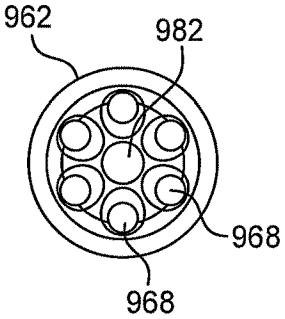
FIG. 11A is a front view of an upstream end of the sensor adapter of FIG. 9.

FIG. 9 shows the milling tool 100 equipped with another embodiment of a sensor adapter. FIG. 10 is an enlarged partial view of FIG. 9 including the sensor adapter 960. The milling tool 100 is similar to the milling tool 100 of FIG. 1. For clarity's sake, similar features are designated with the same reference number and will not be described further in detail. The adapter 960 is disposed in the bore 115 of the tubular body 112 of the first mill 110. FIG. 11 is a perspective view of the sensor adapter 960 from the downstream end. FIG. 11A is a front view of the upstream end of the sensor adapter 960.

The sensor adapter 960 includes an adapter body 962 movably coupled to the inner surface of the tubular body 112. In one embodiment, the adapter body 962 is a hydraulic sleeve that is axially movable in the bore 115 of the tubular body 112 of the first mill 110. The adapter body 962 may be disposed in a recessed portion 117 of the bore 115 and between two shoulders of the recessed portion 117. The recessed portion 117 has a larger diameter than the bore 115. Sealing members 119 such as O-rings are disposed between the adapter body 962 and the tubular body 112 and disposed at opposite ends of the adapter body 962. The upstream portion of the adapter body 962 includes an upper flow bore 981 that is larger than a receiver bore 982 in the downstream portion. The receiver bore 982 is configured to connect to the carrier 952 of the sensor assembly 950. In this embodiment, the receiver bore 982 includes threads 983 for connection with threads 953 on the exterior surface of the carrier 952. It is contemplated that the receiver bore 982 may be connected to the sensor assembly 950 using other suitable connection devices, such as a screw or a snap ring.

In this embodiment, the receiver bore 982 is positioned in co-axial alignment with the longitudinal axis of the adapter body 962. This arrangement also positions the sensor assembly 950 in co-axial alignment with the tubular body 112. One or more channels 968 are disposed in the downstream portion of the adapter body 962. The channels 968 are disposed around the receiver bore 982 for fluid communication through the sensor adapter 960. FIGS. 11 and 11A shows six channels 968 disposed circumferentially around the receiver bore 982, although any suitable number of channels may be used. The channels 968 are in fluid communication with the upper flow bore 981. The channels 968 may be sized for maximum fluid flow through the adapter body 962. In one example, the channels 968 are bores formed through the adapter body 962. In one embodiment, the upper ends of the channels 968 open to the bore 981 are recessed. The upstream end of the carrier 952 has a bullet nose shape 969 to deflect flow into the channels 968. In another embodiment, the receiver bore 982 may be eccentrically positioned relative to the longitudinal axis of the adapter body.

Figure 12:
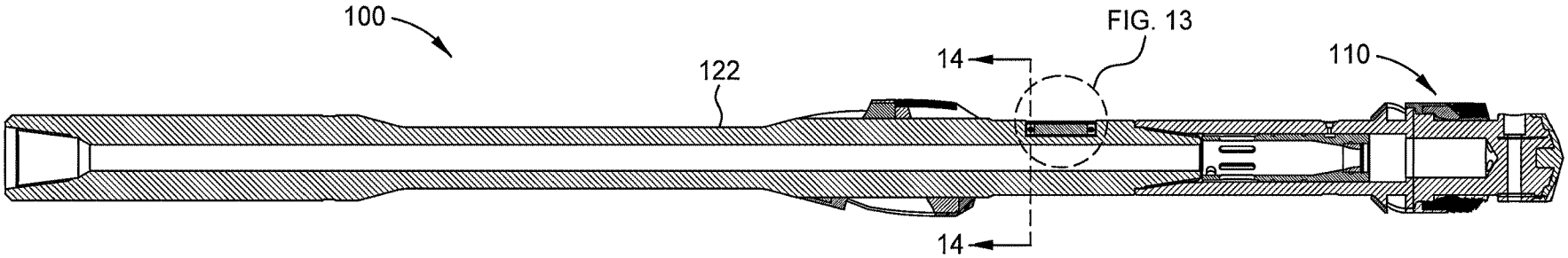
FIG. 12 shows a perspective view of a milling tool equipped with a sensor assembly according to another embodiment.
Figure 13:
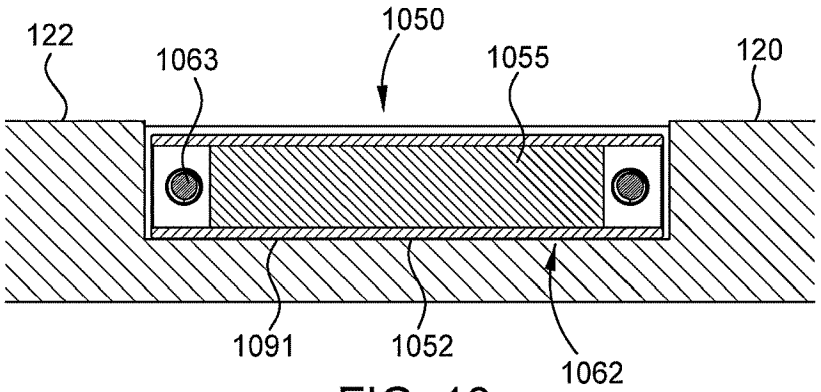
FIG. 13 is an enlarged partial view of the milling tool of FIG. 12.
Figure 14:
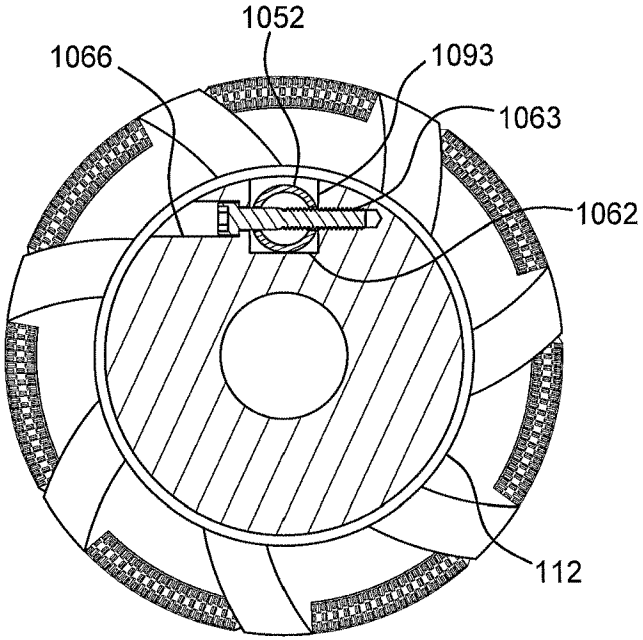
FIG. 14 is a cross-sectional view of the milling tool taken along line 14-14 in FIG. 12.

FIG. 12 shows a perspective view of a milling tool 100 equipped with a sensor assembly 1050 according to one embodiment. FIG. 13 is an enlarged partial view of FIG. 12. FIG. 14 is a cross-sectional view of the milling tool 100 taken along line 14-14 in FIG. 12. The milling tool 100 is similar to the milling tool 100 of FIG. 1. For clarity's sake, similar features are designated with the same reference number and will not be described further in detail. The milling tool 100 includes a pocket 1062 formed in the wall of the tubular body 122 of the second mill 120. In one example, the pocket 1062 is formed by milling. In one embodiment, the pocket 1062 includes a floor 1091 and two sidewalls 1093. The sensor assembly 1050 includes one or more sensors 1055 disposed in a carrier 1052. In one example, the carrier 1052 includes a bore for receiving the sensor 1055 therein. In this embodiment, the carrier 1052 extends past the sensor 1055 at both ends. In one embodiment, the carrier 1052 is attached to the tubular body 122 using a connection device such as a screw 1063. Each of the screws 1063 may be inserted through a bore 1066 formed in the tubular body 122 and through a hole formed in the carrier 1052. In one example, the bore 1066 is formed along a non-radial direction in the tubular body 122 and through at least a portion of both sidewalls 1093. One or both ends of the bore 1066 may be open to the exterior of the tubular body 122. An exemplary screw 1063 is a socket head cap screw. It is contemplated that the pocket 1062 may be formed in the first mill 110.

Figure 15:
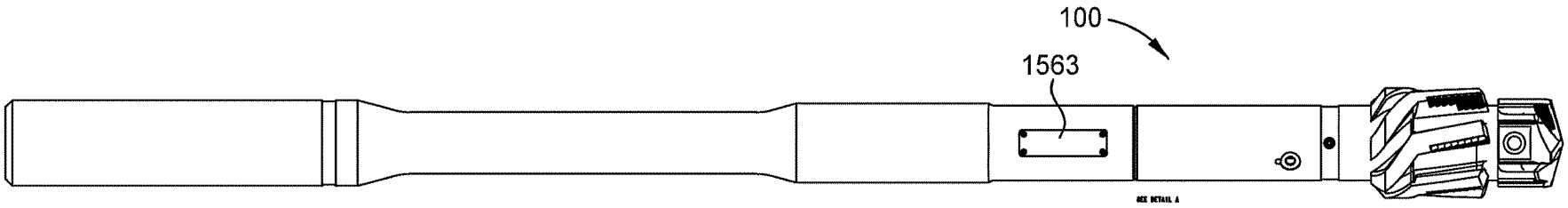
FIG. 15 shows a perspective view of a milling tool equipped with a sensor assembly according to another embodiment.
Figure 15A:
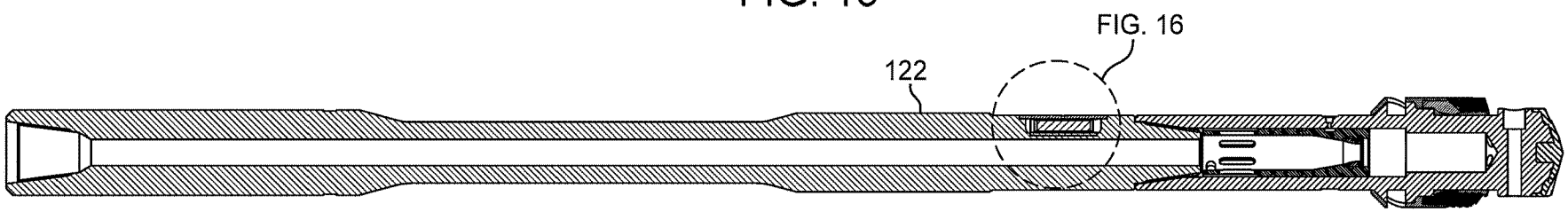
FIG. 15A is a cross-sectional view of the milling tool of FIG. 15.
Figure 17:
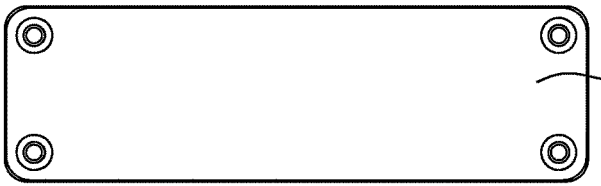
FIG. 17 is a top view of a cover plate of FIG. 15.
Figure 16:
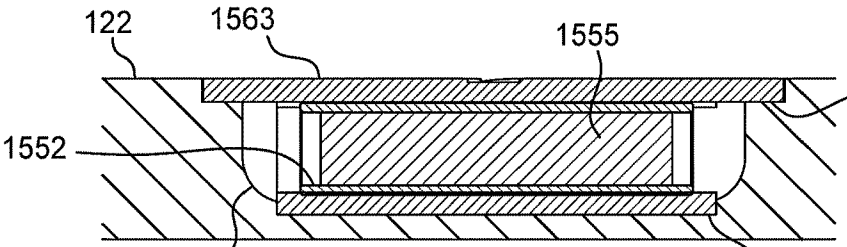
FIG. 16 is an enlarged partial view of the milling tool of FIG. 15A.

FIG. 15 shows a perspective view of a milling tool 100 equipped with a sensor assembly according to one embodiment. FIG. 15A is a cross-sectional view of the milling tool 100 of FIG. 15. FIG. 16 is an enlarged partial view of FIG. 15A showing the sensor assembly 1550. The milling tool 100 is similar to the milling tool 100 of FIG. 1. For clarity's sake, similar features are designated with the same reference number and will not be described further in detail. The milling tool 100 includes a pocket 1562 formed in the wall of the tubular body 122 of the second mill 120, as seen in FIG. 16. In one example, the pocket 1562 is formed by milling. The sensor assembly 1550 includes one or more sensors 1555 disposed in a carrier 1552. In one example, the carrier 1552 of the sensor assembly 1550 includes a bore for receiving the sensor 1555 therein. In one embodiment, a cover plate 1563 is used to retain the sensor assembly 1550 in the pocket 1562. FIG. 17 is a top view of the cover plate 1563. The cover plate 1563 may be disposed in an optional recess 1522 formed on the outer surface of the tubular body 122 and around the pocket 1562. The cover plate 1563 may be attached using any suitable attachment mechanism. For example, four screws positioned at the four corners of the cover plate 1563 are used to attach the cover plate 1563 to the tubular body 122. In another embodiment, an optional dampener 1557 may be disposed around the carrier 1552. The dampener 1857 may minimize the vibration experienced by the sensors 1855. The exterior of the dampener 1557 may contact the pocket 1562 and the cover plate 1563. The dampener 1557 may be made from a rubber material or a polymeric material.

Figure 18:
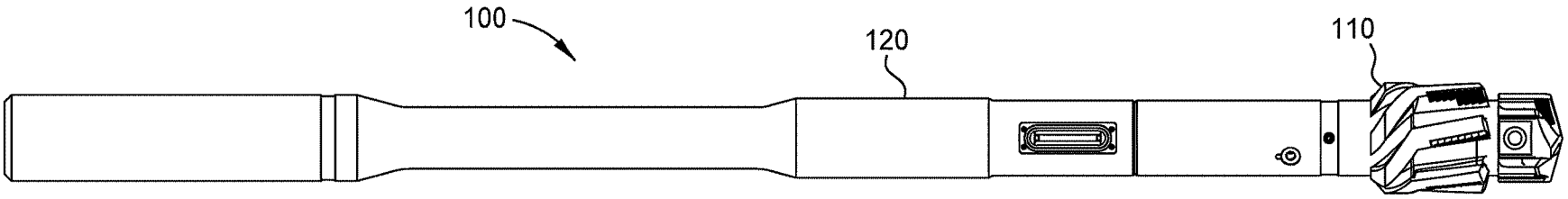
FIG. 18 shows a perspective view of a milling tool equipped with a sensor assembly according to another embodiment.
Figure 18A:
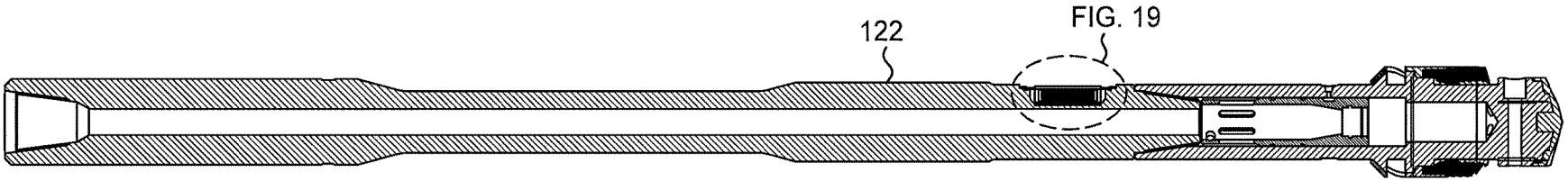
FIG. 18A is a cross-sectional view of the milling tool of FIG. 18.
Figure 20:
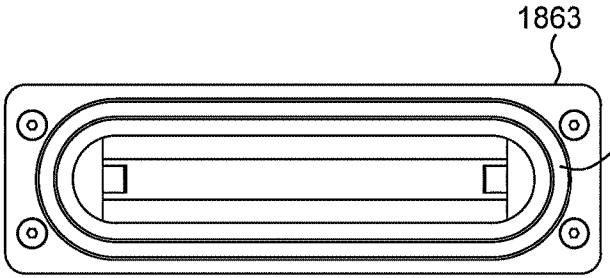
FIG. 20 is a top view of the cover plate of FIG. 18.
Figure 19:
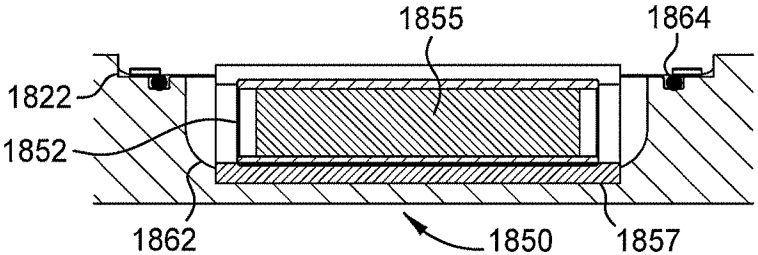
FIG. 19 is an enlarged partial view of the milling tool of FIG. 18A.

FIG. 18 shows a perspective view of a milling tool 100 equipped with a sensor assembly 1850 according to one embodiment. FIG. 18A is a cross-sectional view of the milling tool 100 of FIG. 18. FIG. 19 is an enlarged partial view of FIG. 18A. The milling tool 100 is similar to the milling tool 100 of FIG. 1. For clarity's sake, similar features are designated with the same reference number and will not be described further in detail. The milling tool 100 includes a pocket 1862 formed in the wall of the tubular body 122 of the second mill 120. In one example, the pocket 1862 is formed by milling. The sensor assembly 1850 includes one or more sensors 1855 disposed in a carrier 1852. In one example, the carrier 1852 of the sensor assembly 1850 includes a bore for receiving the sensor 1855 therein. In one embodiment, a cover plate 1863 is used to retain the sensor assembly 1850 in the pocket 1862. FIG. 20 is a top view of the cover plate 1863. The cover plate 1863 may be disposed in an optional recess 1822 formed on the outer surface of the tubular body 122 and around the pocket 1862. The cover plate 1863 may be attached using any suitable attachment mechanism. For example, four screws positioned at the four corners of the cover plate 1863 are used to attach the cover plate 1863 to the tubular body 122. In another embodiment, an optional sealing ring 1864, such as an O-ring, is disposed around the pocket and between the tubular body 122 and the cover plate 1863. The sealing ring 1864 may be disposed in a recess formed in the tubular body 122. Optionally, the cover plate 1863 may include a groove to accommodate the sealing ring 1864. In yet another embodiment, an optional dampener 1857 is disposed, either fully or partially, around the carrier 1852. The exterior of the dampener 1857 may contact the pocket 1862 and the cover plate 1863. The dampener 1857 may be made from a rubber material or a polymeric material. The dampener 1857 may minimize the vibration experienced by the sensors 1855.

Figure 21:
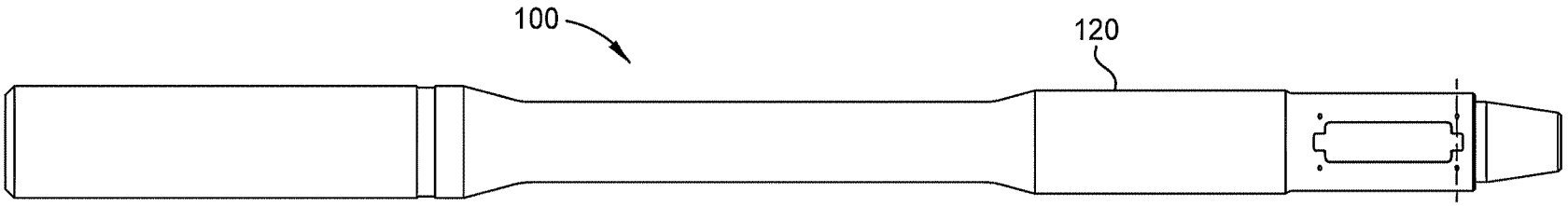
FIG. 21 shows a perspective view of a milling tool equipped with a sensor assembly according to one embodiment.
Figure 21A:
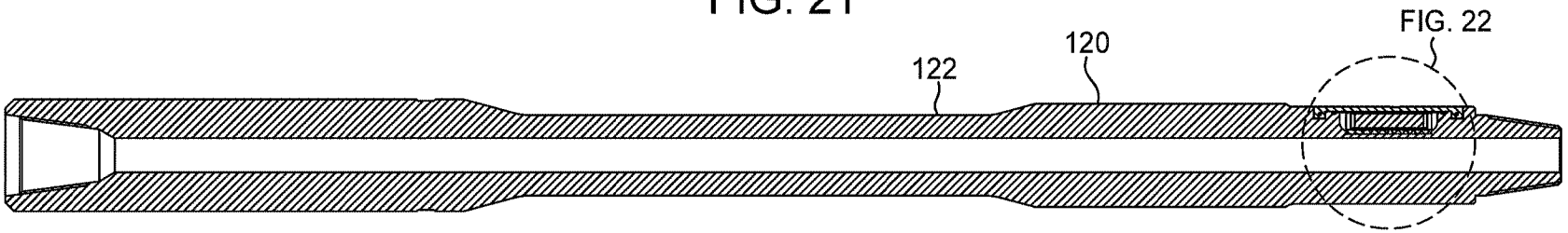
FIG. 21A is a cross-sectional view of the milling tool of FIG. 21.
Figure 23:
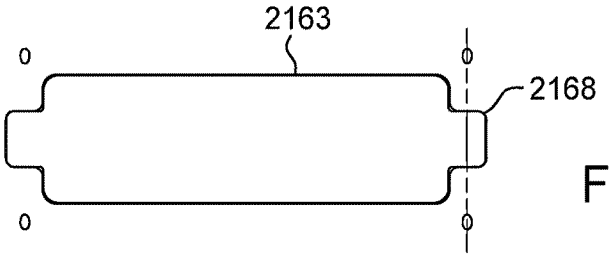
FIG. 23 is a top view of the cover plate of FIG. 21.
Figure 22:
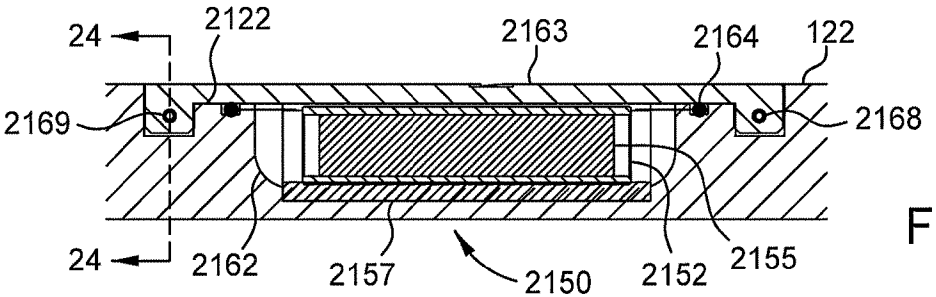
FIG. 22 is an enlarged partial view of the milling tool of FIG. 21A.
Figure 24:
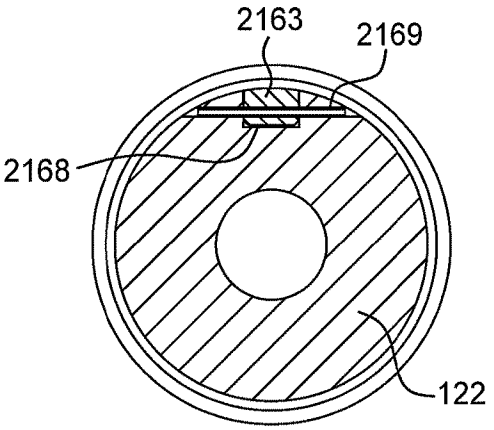
FIG. 24 is a cross-sectional view of the milling tool along line 24-24 of FIG. 22.

FIG. 21 shows a perspective view of a milling tool 100 equipped with a sensor assembly according to one embodiment. FIG. 21A is a cross-sectional view of the milling tool 100 of FIG. 21. FIG. 22 is an enlarged partial view of FIG. 21A including the sensor assembly 2150. The milling tool 100 is similar to the milling tool 100 of FIG. 1. For clarity's sake, similar features are designated with the same reference number and will not be described further in detail. The milling tool 100 includes a pocket 2162 formed in the wall of the tubular body 122 of the second mill 120. In one example, the pocket 2162 is formed by milling. The sensor assembly 2150 includes one or more sensors 2155 disposed in a carrier 2152. In one example, the carrier 2152 of the sensor assembly 2150 includes a bore for receiving the sensor 2155 therein. In one embodiment, a cover plate 2163 is used to retain the sensor assembly 2150 in the pocket 2162. FIG. 23 is a top view of the cover plate 2163. FIG. 24 is a cross-sectional view of the milling tool 100 along line 24-24. As shown in FIG. 22, the cover plate 2163 may be disposed in a recess 2122 formed on the outer surface of the tubular body 122 and around the pocket 2162. The cover plate 2163 may be attached using any suitable attachment mechanism. For example, the cover plate 2163 includes a shoulder 2168 at both ends for coupling with the tubular body 122. As shown, a drive pin 2169 may be inserted through the tubular body 122 and the shoulder 2168 at each end of the cover plate 2163. In another embodiment, an optional sealing ring 2164, such as an O-ring, is disposed around the pocket and between the tubular body 122 and the cover plate 2163. The sealing ring 2164 may be disposed in a recess formed in the tubular body 122. In yet another embodiment, an optional dampener 1857 is disposed, either fully or partially, around the carrier 2152. The exterior of the dampener 2157 may contact the pocket 2162 and the cover plate 2163. The dampener 2157 may be made from a rubber material or a polymeric material. The dampener 1857 may minimize the vibration experienced by the sensors 1855.

Figure 25:
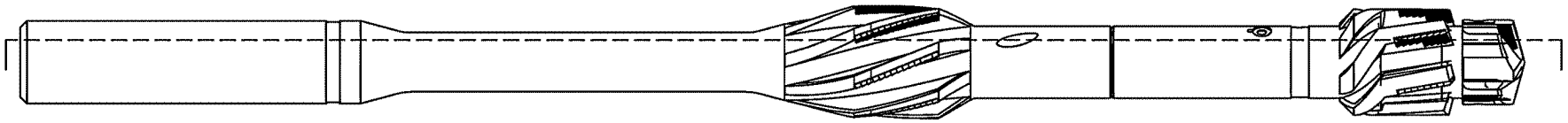
FIG. 25 shows a perspective view of a milling tool equipped with a sensor assembly according to one embodiment.
Figure 25A:
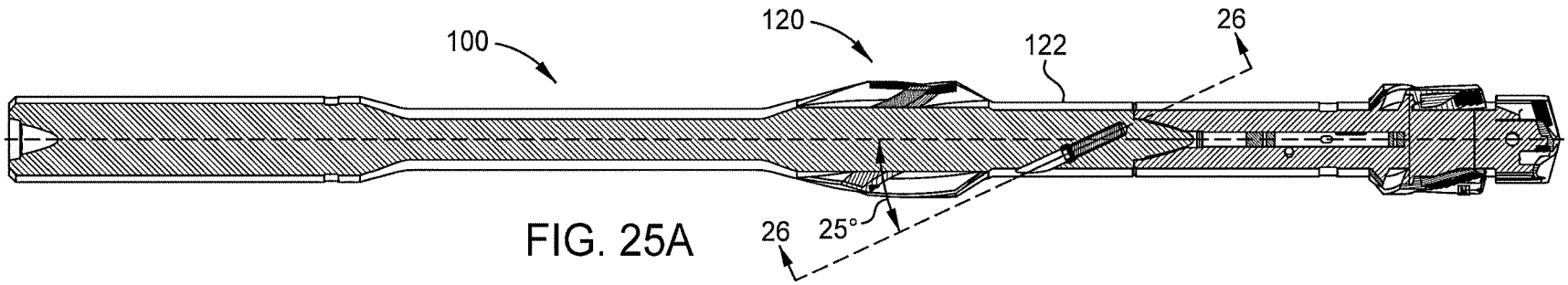
FIG. 25A is a cross-sectional view of the milling tool of FIG. 25.
Figure 26:
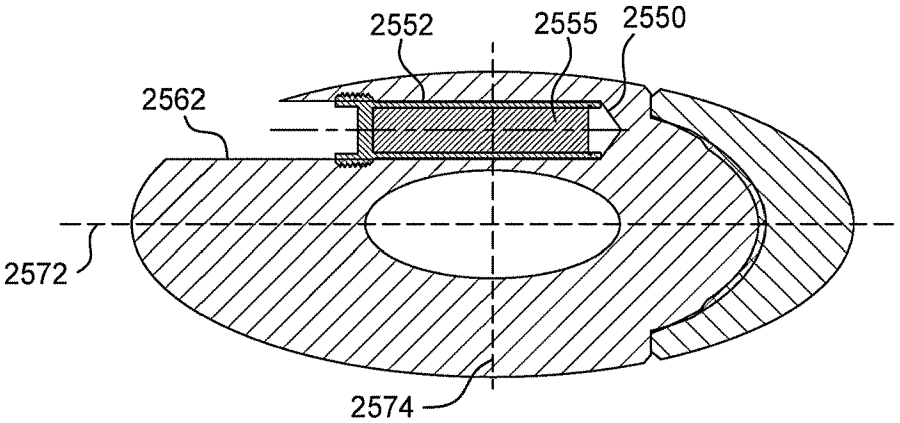
FIG. 26 is a cross-sectional view of the milling tool along line 26-26 of FIG. 25A.

FIG. 25 shows a perspective view of a milling tool 100 equipped with a sensor assembly 2550 according to one embodiment. FIG. 25A is a cross-sectional view of the milling tool 100 of FIG. 25. FIG. 26 is a cross-sectional view of the milling tool 100 along line 26-26. The milling tool 100 is similar to the milling tool 100 of FIG. 1. For clarity's sake, similar features are designated with the same reference number and will not be described further in detail. The milling tool 100 includes a hole 2562 formed in the wall of the tubular body 122 of the second mill 120. In one example, the hole 2562 is formed by drilling into the tubular body 122. The hole 2562 is sized to receive the sensor assembly 2550 therein. A central axis of the hole 2562 may be formed parallel to a horizontal plane 2572 intersecting the central axis of the tubular body 122. It is contemplated that the central axis of the hole 2562 may deviate from the horizontal plane by up to 15 degrees. The hole 2562 is also formed at an angle relative to a vertical plane 2574 intersecting the central axis of the tubular body 122. In one embodiment, the hole 2562 may be formed at an angle from about 10 degrees to about 80 degrees, or from about 15 degrees to about 45 degrees, or from about 20 degrees to 30 degrees, such as 25 degrees, relative to the vertical plane 2574. In another embodiment, the hole 2562 may be formed at an angle from about 0 degree to about 90 degrees relative to the vertical plane 2574. The sensor assembly 2550 includes a sensor 2555 disposed in a carrier 2552. The carrier 2552 may include threads for connection with threads formed in the hole 2562. In one example, the threads of the carrier 2552 are NPT threads. FIGS. 25A and 26 show the sensor assembly 2550 disposed parallel to the horizontal plane 2572 and at a 25-degree angle relative to the vertical plane 2574.

Figure 27:
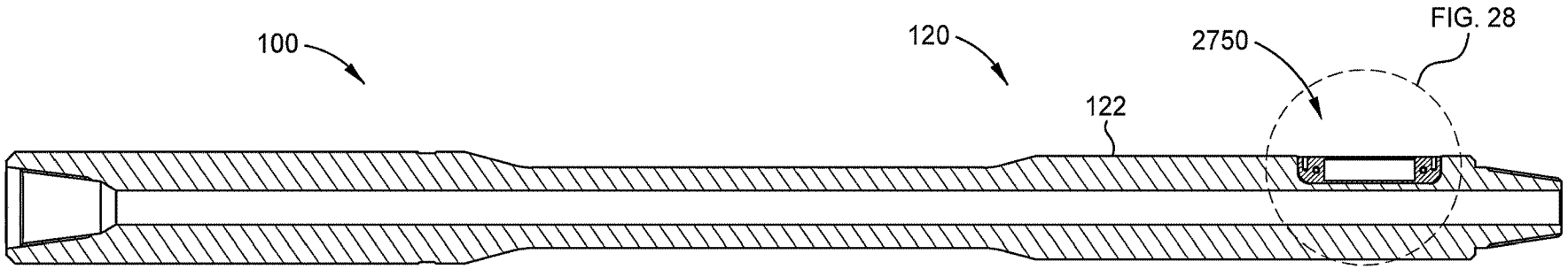
FIG. 27 shows a partial, top view of a milling tool equipped with a sensor assembly according to one embodiment.
Figure 28:
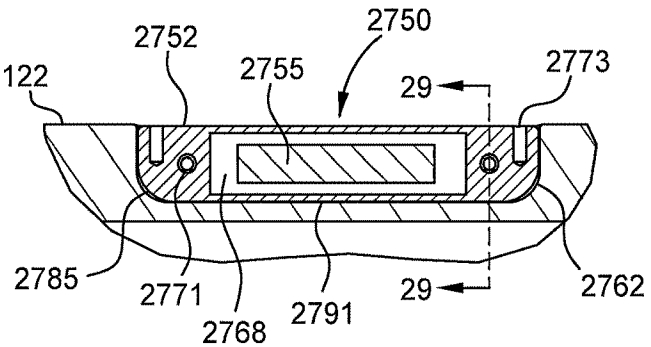
FIG. 28 is an enlarged partial view of FIG. 27.
Figure 30A:
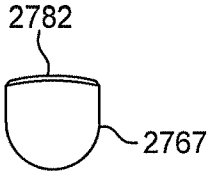
FIGS. 30, 30A, and 30B are a perspective view, a front view, and a top view, respectively, of the sensor assembly of FIGS. 27 and 28.
Figure 30:
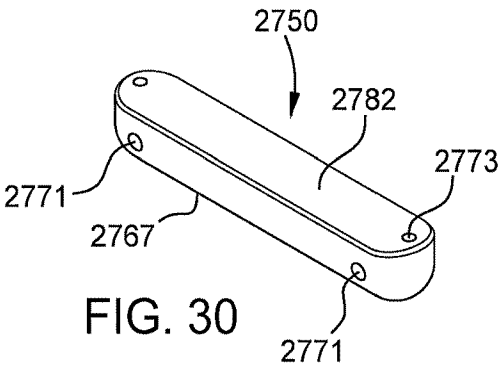
Figure 30B:
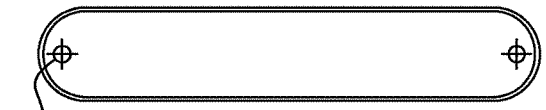
Figure 29:
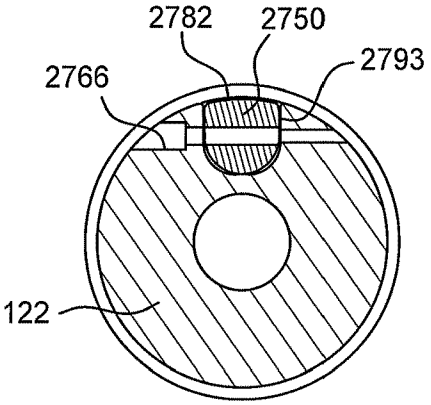
FIG. 29 is a cross-sectional view of the milling tool taken along line 29 in FIG. 28.

FIG. 27 shows a partial, top view of a milling tool 100 equipped with a sensor assembly 2750 according to one embodiment. FIG. 28 is an enlarged partial view of FIG. 27. FIG. 29 is a cross-sectional view of the milling tool 100 taken along line 29 in FIG. 28. The milling tool 100 is similar to the milling tool 100 of FIG. 1. For clarity's sake, similar features are designated with the same reference number and will not be described further in detail. The milling tool 100 includes a pocket 2762 formed in the wall of the tubular body 122 of the second mill 120. In one example, the pocket 2762 is formed by milling. In one embodiment, the pocket 2762 includes a floor 2791 and two sidewalls 2793. In this example, the floor 2791 transitions to the sidewalls 2793 via arcuate corners. The sensor assembly 2750 includes one or more sensors 2755 disposed in a carrier 2752. FIGS. 30, 30A, and 30B are a perspective view, a front view, and a top view, respectively, of the sensor assembly 2750. In one example, the carrier 2752 includes a body 2767 having a cavity 2768 for receiving the sensor 2755 therein. The carrier 2752 may be made from a metal material such as steel. In some embodiments, the carrier 2752 is made from a solid piece of metal material, such as steel, and the cavity 2768 is formed in the carrier 2752 by milling. In some embodiments, the carrier 2752 is made by connecting two metal pieces. In one embodiment, a cover such as a cover plate may be attached to the top surface of the carrier 2752 to close the cavity. In another embodiment, the cover plate may be attached using a connection device such as a screw or pin or an adhesive. In another embodiment, the carrier 2752 may have an opening at a sidewall or at an end for insertion of the sensor 2755 into the cavity 2768. The opening is closed after the sensor 2755 has been inserted therein. In some embodiments, the carrier body 2767 includes a retrieval hole 2773 at the outer surface to facilitate removal of the carrier 2752 from the milling tool 100. For example, the retrieval hole 2773 may include threads for connection to a retrieval tool.

In the example shown in FIGS. 28 and 29, the carrier 2752 is sized to correspond to the dimensions of the pocket 2762. In this example, the front end, bottom end, and side walls of the carrier 2752 may be sized to contact the pocket 2762, and a slight clearance may exist at the arcuate corners. In one example, the clearance is 0.25 inches or less, 0.2 inches or less, or 0.15 inches or less. In some embodiments, the top surface of the carrier 2752 may have a curvature 2782 that is substantially similar to the curvature of the tubular body 122. For example, as seen in FIG. 29, the curvature 2782 of the top surface may have a radius that is the same as the radius of the tubular body 122 or may have a radius that is the same as or within 85% or within 95% of the radius of the tubular body 122. In one example, the curvature 2782 of the top surface has a radius that from 90% to 99% of the radius of the tubular body 122. In some embodiments, the top surface of the carrier 1752 may be located at or slightly below the outer surface of the tubular body 122. For example, the top surface of the carrier 1752 may be located from 0.001 inches to 0.15 inches below the outer surface of the tubular body 122. In one embodiment, the carrier 2752 is attached to the tubular body 122 using a connection device such as a screw, bolt, or pin. Each of the connection device may be inserted through a bore 2766 formed in the tubular body 122 and through a mounting hole 2771 formed in the carrier 2752. In one example, the bore 2766 is formed along a non-radial direction in the tubular body 122 and through at least a portion of both sidewalls 2793. One or both ends of the bore 2766 may be open to the exterior of the tubular body 122. An exemplary screw is a socket head cap screw. It is contemplated that the pocket 2762 may be formed in the first mill 110. In some embodiments, the mounting holes 2771 are formed at a location that does not intersect with a radius of the ends of the sensor carrier 2752. As seen in FIG. 28, the two ends of the sensor carrier 2752 have curved corner surface 2785 as a transition from the ends to the body length. The mounting holes 2771 are located outside of the radius of the curved corners 2785 of the sensor carrier 2752. It is believed this location of the mounting holes 2771 may protect the tool body 122 from rotating and/or bending fatigue.

In one embodiment, a downhole assembly includes a tubular body having a bore; a downhole tool connected to the tubular body; a sensor assembly having a carrier and a sensor for measuring a geophysical parameter; and a sensor adapter for coupling the sensor assembly to the tubular body. The sensor adapter includes an adapter body disposed in the bore of the tubular body; an adapter shaft for connection with the carrier; and a plurality of channels formed between the adapter shaft and the adapter body.

In one or more of the embodiments described herein, the downhole tool is a milling tool.

In one or more of the embodiments described herein, the sensor includes at least one of a magnetometer, a micro-electromechanical system ("MEMS")-based sensor, a gyrometer, a Geiger-Müller tube sensor, and an accelerometer.

In one or more of the embodiments described herein, the adapter shaft is connected to the carrier using threads.

In one or more of the embodiments described herein, the sensor assembly is co-axially aligned with a longitudinal axis of the tubular body.

In one or more of the embodiments described herein, the adapter body includes threads for mating with threads in tubular body.

In one or more of the embodiments described herein, the downhole assembly includes a secondary connection device for connecting the adapter body to the tubular body.

In one or more of the embodiments described herein, the downhole assembly includes sealing members disposed between the adapter body and the tubular body.

In one or more of the embodiments described herein, the adapter body is positioned adjacent a threaded portion of the tubular body configured to connect with another tubular body.

In one or more of the embodiments described herein, the carrier is elongated to increase the distance between the sensor and the adapter body.

In another embodiment, a downhole assembly includes a tubular body having a bore; a downhole tool connected to the tubular body; a sensor assembly having a carrier and a sensor; a sensor adapter for coupling the sensor assembly to the tubular body. The sensor adapter includes an adapter body disposed in the bore of the tubular body; a receiver bore for connection with the carrier; and a plurality of channels formed between the receiver bore and the adapter body.

In one or more of the embodiments described herein, the downhole tool is a milling tool.

In one or more of the embodiments described herein, the sensor includes at least one of a magnetometer, a micro-electromechanical system ("MEMS")-based sensor, a gyrometer, a Geiger-Müller tube sensor, and an accelerometer.

In one or more of the embodiments described herein, the receiver is connected to the carrier using threads.

In one or more of the embodiments described herein, the sensor assembly is co-axially aligned with a longitudinal axis of the tubular body.

In one or more of the embodiments described herein, the adapter body comprises a hydraulic sleeve having a flow bore that is larger than the receiver bore.

In another embodiment, a downhole assembly includes a tubular body having a bore; a downhole tool connected to the tubular body; a sensor assembly having a carrier and a sensor; a pocket formed in a wall of the tubular body for receiving the sensor assembly; and a screw for retaining the sensor assembly in the pocket, the screw insert in a non-radial direction through the pocket.

In one or more of the embodiments described herein, the downhole tool is a milling tool.

In one or more of the embodiments described herein, the sensor includes at least one of a magnetometer, a micro-electromechanical system ("MEMS")-based sensor, a gyrometer, a Geiger-Müller tube sensor, and an accelerometer.

In another embodiment, a downhole assembly includes a tubular body having a bore; a downhole tool connected to the tubular body; a sensor assembly having a carrier and a sensor; a pocket formed in a wall of the tubular body for receiving the sensor assembly; and a cover plate disposed above the pocket and attached to the outer surface of the tubular body, thereby retaining the sensor assembly in the pocket.

In one or more of the embodiments described herein, the downhole tool is a milling tool.

In one or more of the embodiments described herein, the sensor includes at least one of a magnetometer, a micro-electromechanical system ("MEMS")-based sensor, a gyrometer, a Geiger-Müller tube sensor, and an accelerometer.

In one or more of the embodiments described herein, the downhole assembly includes a plurality of screws for attaching the cover plate to the tubular body.

In one or more of the embodiments described herein, the downhole assembly includes a dampener disposed around the carrier.

In one or more of the embodiments described herein, the downhole assembly includes a sealing member disposed around the perimeter of the pocket and disposed between the tubular body and the cover plate.

In one or more of the embodiments described herein, the downhole assembly includes drive pins for attaching the cover plate to the tubular body.

In one or more of the embodiments described herein, the drive pins are inserted through a shoulder of the cover plate.

In another embodiment, a downhole assembly includes a tubular body having a bore; a downhole tool connected to the tubular body; a sensor assembly having a carrier and a sensor; and a hole formed in a wall of the tubular body for receiving the sensor assembly, wherein the hole is formed at an angle relative to a vertical plane intersecting a central axis of the tubular body.

In one or more of the embodiments described herein, the hole is formed substantially parallel to a horizontal plane intersecting the central axis of the tubular body.

In one or more of the embodiments described herein, the hole is formed within a 15-degree angle relative to a horizontal plane intersecting the central axis of the tubular body.

In one or more of the embodiments described herein, the hole formed at an angle from about 15 degrees to about 45 degrees relative to the vertical plane.

In one or more of the embodiments described herein, the downhole tool is a milling tool.

In one or more of the embodiments described herein, the sensor includes at least one of a magnetometer, a micro-electromechanical system ("MEMS")-based sensor, a gyrometer, a Geiger-Müller tube sensor, and an accelerometer.

In one or more of the embodiments described herein, the carrier includes threads for mating with threads in the hole.

In another embodiment, a downhole assembly includes a tubular body having a bore; a downhole tool connected to the tubular body; a sensor assembly; and a pocket formed in a wall of the tubular body for receiving the sensor assembly, wherein the carrier substantially conforms to the dimensions of the pocket. The sensor assembly includes a carrier having a cavity and a sensor disposed in the cavity.

In one or more of the embodiments described herein, a top surface of the carrier includes a curvature having a radius that is from 90% to 99% of a radius of the tubular body 122.

While the foregoing is directed to embodiments of the present disclosure, other and further embodiments of the disclosure may be devised without departing from the basic scope thereof, and the scope thereof is determined by the claims that follow.

The invention claimed is:

1. A downhole assembly, comprising:

a tubular body defining a bore therethrough and having a wall, the bore defining a diameter, the tubular body defining a hole in the wall of the tubular body, the hole being defined at an angle relative to a vertical plane intersecting a central axis of the tubular body;

a downhole tool connected to the tubular body and disposed in communication with the bore;

a sensor having a longitudinal length, the sensor disposed in the hole at the angle relative to the vertical plane intersecting the central axis of the tubular body such that the longitudinal length fits entirely across the diameter of the bore; and a carrier affixed in the hole and retaining the sensor in the hole of the tubular body.

2. The downhole assembly of claim 1, wherein the angle is defined from about 15 degrees to about 45 degrees relative to the vertical plane intersecting the central axis.

3. The downhole assembly of claim 1, wherein the hole defines first thread therein; and wherein the carrier comprises second thread disposed on the carrier, the second thread of the carrier mating with the first thread defined in the hole.

4. The downhole assembly of claim 3, wherein the second thread of the carrier is NPT thread.

5. The downhole assembly of claim 1, wherein one of:

the hole is defined parallel to a horizontal plane intersecting a central axis of the tubular body; and the hole is defined within a 15-degree angle relative to the horizontal plane intersecting the central axis of the tubular body.

6. The downhole assembly of claim 1, wherein the carrier defines a cavity; and wherein the sensor is disposed in the cavity.

7. The downhole assembly of claim 6, wherein the carrier comprises a sidewall, an open distal end, and a closed proximal end, the sidewall and the closed proximal end enclosing the cavity, the sensor disposed in cavity through the open distal end, the sidewall substantially conforming to the hole.

8. The downhole assembly of claim 1, wherein the sensor in the hole is separated by a section of the wall from the bore in the tubular body.

9. The downhole assembly of claim 1, wherein the tubular body has an uphole end and a downhole end, the downhole tool connected to the downhole end; and wherein the hole having the sensor is disposed toward the downhole end.

10. The downhole assembly of claim 1, wherein the downhole tool is a milling tool.

11. The downhole assembly of claim 1, wherein the sensor includes at least one of a magnetometer, a micro electro-mechanical systems ("MEMS")-based sensor, a gyrometer, a Geiger-Müller tube sensor, and an accelerometer.

12. The downhole assembly of claim 1, wherein the hole formed in the wall of the tubular body is entirely enclosed by the wall of the tubular body and defines an opening exposed at an exterior surface of the tubular body.

13. A downhole assembly, comprising:

a tubular body defining a bore therethrough and having a wall, the bore defining a diameter, the tubular body having a hole formed in the wall, the hole being formed at an angle relative to a vertical plane intersecting a central axis of the tubular body;

a downhole tool connected to the tubular body and disposed in communication with the bore; and a sensor assembly disposed in the hole and having a carrier and a sensor, the carrier retaining the sensor in the hole, the sensor having a longitudinal length, the sensor disposed in the hole at the angle relative to the vertical plane intersecting the central axis of the tubular body such that the longitudinal length fits entirely across the diameter of the bore.

14. The downhole assembly of claim 13, wherein one of:

the hole is formed parallel to a horizontal plane intersecting the central axis of the tubular body; and the hole is defined within a 15-degree angle relative to the horizontal plane intersecting the central axis of the tubular body.

15. The downhole assembly of claim 13, wherein the hole is formed at the angle from about 15 degrees to about 45 degrees relative to the vertical plane.

16. The downhole assembly of claim 13, wherein the carrier includes first threads mating with second threads in the hole.

17. The downhole assembly of claim 13, wherein the carrier comprises a sidewall, an open distal end, and a closed proximal end, the sidewall and the closed proximal end enclosing a cavity, the sensor disposed in cavity through the open distal end, the sidewall substantially conforming to the hole.

18. The downhole assembly of claim 13, wherein the tubular body has an uphole end and a downhole end, the downhole tool connected to the downhole end; and wherein the hole having the sensor assembly is disposed toward the downhole end.

19. The downhole assembly of claim 13, wherein the sensor includes at least one of a magnetometer, a micro electro-mechanical systems ("MEMS")-based sensor, a gyrometer, a Geiger-Müller tube sensor, and an accelerometer.

20. The downhole assembly of claim 13, wherein the hole formed in the wall of the tubular body is entirely enclosed by the wall of the tubular body and defines an opening exposed at an exterior surface of the tubular body.

* * * * *